US010857579B2

(12) United States Patent
Guasti

(10) Patent No.: US 10,857,579 B2
(45) Date of Patent: Dec. 8, 2020

(54) APPARATUS FOR FORMING IN CONTINUOUS A SPIRAL SEAMED CONDUIT, FORMING PROCESS AND SPRIRAL CONDUIT

(71) Applicant: ZEFFIRO SRL, Barberino di Mugello (IT)

(72) Inventor: Gino Guasti, Barberino di Mugello (IT)

(73) Assignee: ZEFFIRO SRL, Barberino di Mugello (IT)

( * ) Notice: Subject to any disclaimer, the term of this patent is extended or adjusted under 35 U.S.C. 154(b) by 0 days.

(21) Appl. No.: 16/633,107

(22) PCT Filed: Jul. 24, 2018

(86) PCT No.: PCT/IB2018/000781
§ 371 (c)(1),
(2) Date: Jan. 22, 2020

(87) PCT Pub. No.: WO2019/025851
PCT Pub. Date: Feb. 7, 2019

(65) Prior Publication Data

US 2020/0230675 A1 Jul. 23, 2020

(30) Foreign Application Priority Data

Jul. 31, 2017 (IT) ..... 102017000086880

(51) Int. Cl.
*B21C 37/12* (2006.01)

(52) U.S. Cl.
CPC ..... *B21C 37/121* (2013.01); *B21C 37/124* (2013.01)

(58) Field of Classification Search
CPC ... B21C 37/121; B21C 37/122; B21C 37/124; B21C 37/0803; B21C 37/104; B21C 37/155

(Continued)

(56) References Cited

U.S. PATENT DOCUMENTS 2,339,219 A * 1/1944 Crowiey ..... B21C 37/124 72/50
2,440,792 A * 5/1948 Wyllie ..... B21C 37/124 72/50

(Continued)

*Primary Examiner* — Adam J Eiseman
*Assistant Examiner* — Bobby Yeonjin Kim
(74) *Attorney, Agent, or Firm* — Eandi Fitzpatrick LLP; William Fitzpatrick

(57) ABSTRACT

Apparatus (1) for forming in continuous a spiral seamed conduit (5) from a metallic strip (2) comprising a feeding plane (3) for said metallic strip (2); a forming head (4,4') rotating about a forming axis (A) substantially parallel to the feeding plane (3) and tilted by a forming angle (a) with respect to a direction orthogonal (0) to a feeding direction (F) of the metallic strip, wherein the forming head (4,4') is adapted to drive in rotation said metallic strip (2) for defining a spiral conduit (5); a lock-seaming device (6) configured to lock in continuous two portions of said metallic strip (2) along opposite profiles for forming said spiral seamed conduit (5); wherein said forming head (4,4') is provided with one or more forming elements (7,9) arranged and configured so to define a substantially polygonal shape for the section of said spiral conduit (5) during the drive in rotation of said metallic strip (2); wherein said lock-seaming device (6) is configured to move along a seaming direction (G) so to lock said two portions along a side of said conduit (5); and wherein said apparatus (1) further comprises means configured to move the forming head (4,4') according to a plurality of axes.

The present invention also relates to a process for forming in continuous a spiral conduit (5) having a substantially polygonal section and a spiral conduit (5) having a substantially polygonal section and four flat sides.

11 Claims, 8 Drawing Sheets

(58) Field of Classification Search
USPC ..... 72/49, 50, 135, 142; 29/890.053
See application file for complete search history.

(56) References Cited

U.S. PATENT DOCUMENTS

| | | | | | |
|---|---|---|---|---|---|
| 2,618,233 | A * | 11/1952 | Padgett | B21C 37/124 | 29/561 |
| 2,640,451 | A * | 6/1953 | Carr | B21C 37/124 | 72/50 |
| 2,759,521 | A * | 8/1956 | Hall | B29C 53/827 | 156/429 |
| 3,041,855 | A * | 7/1962 | Hanlein | A44C 5/0076 | 63/5.1 |
| 3,865,146 | A * | 2/1975 | Meserole | F16L 11/16 | 138/154 |
| 3,893,319 | A * | 7/1975 | Zaltron | B21F 43/00 | 72/49 |
| 5,079,938 | A * | 1/1992 | Schwarz | B21C 37/126 | 29/407.04 |
| 6,000,261 | A * | 12/1999 | Johnston | B21C 37/121 | 72/49 |
| 6,003,220 | A * | 12/1999 | Lennartsson | B21C 37/121 | 29/243.58 |
| 6,453,710 | B1 * | 9/2002 | Andresen | B21C 37/121 | 72/49 |
| 7,775,076 | B2 * | 8/2010 | Schultz | B21C 37/121 | 72/49 |
| 8,371,340 | B2 * | 2/2013 | Fubuki | H01F 41/061 | 140/102 |
| 2002/0100304 | A1 * | 8/2002 | Price | B21C 37/127 | 72/50 |
| 2006/0156775 | A1 * | 7/2006 | Nyssen | B21C 37/121 | 72/49 |
| 2008/0072642 | A1 * | 3/2008 | Zepp | B21C 37/124 | 72/49 |
| 2011/0072650 | A1 * | 3/2011 | Cha | B21C 37/121 | 29/700 |
| 2012/0151978 | A1 * | 6/2012 | Zepp | B21C 51/00 | 72/6.1 |
| 2015/0273552 | A1 * | 10/2015 | Minch | B21C 37/121 | 72/50 |

* cited by examiner

II
I
A
20
5
11
7
6
10
3
P
Z
Y
R1

Fig. 9
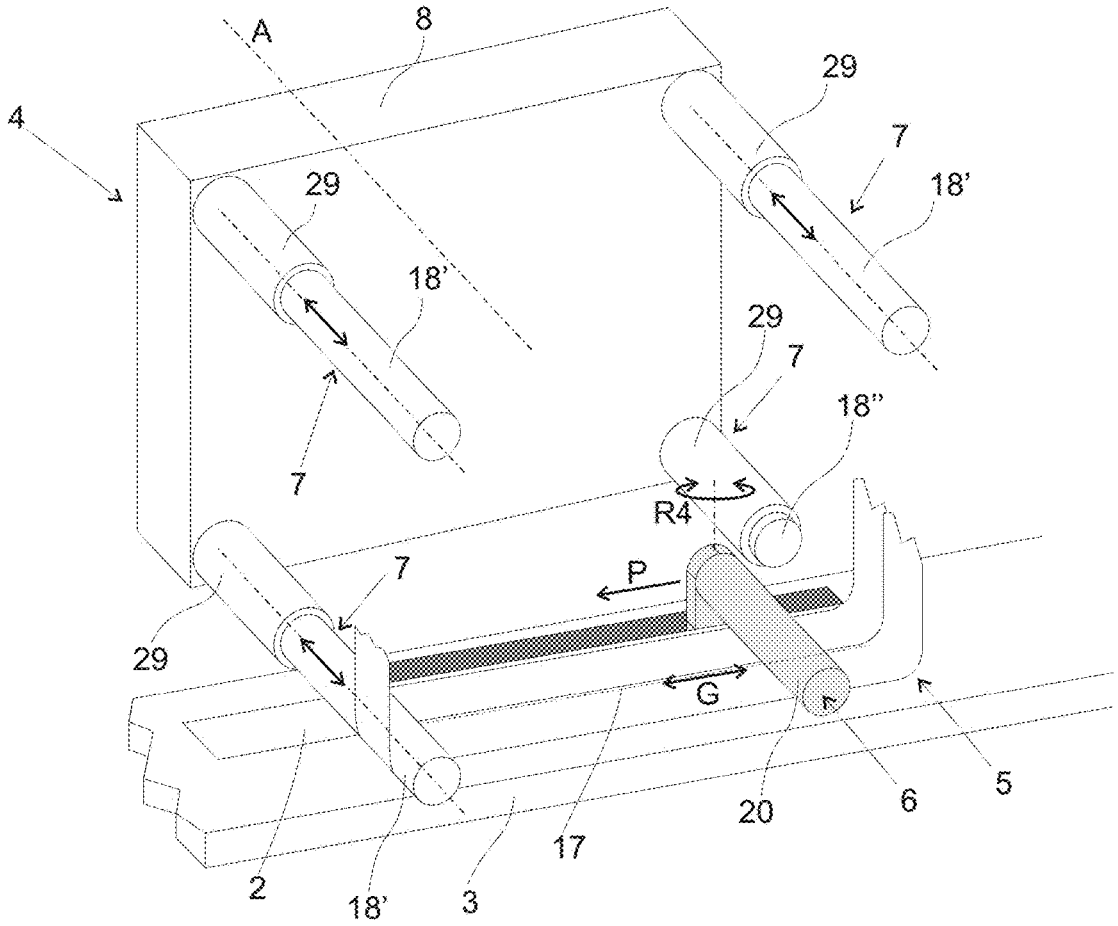
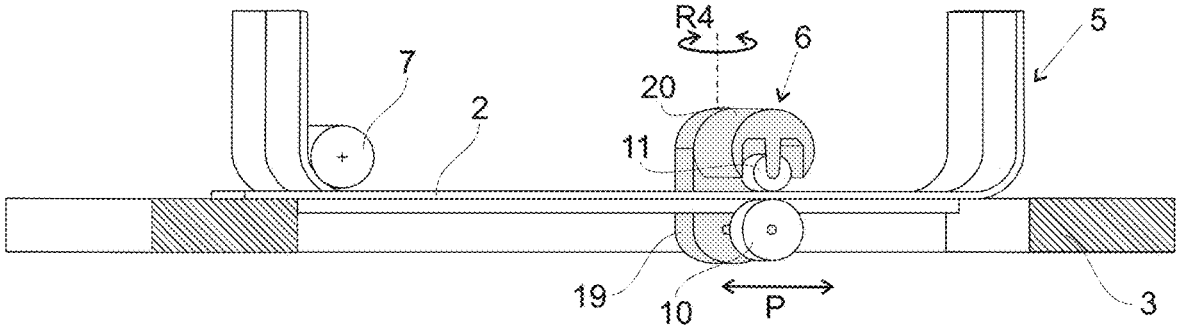
Fig. 10

APPARATUS FOR FORMING IN CONTINUOUS A SPIRAL SEAMED CONDUIT, FORMING PROCESS AND SPRIRAL CONDUIT

TECHNICAL FIELD

The present invention relates to the field of air conduits. In particular, it relates to the field of air conduit for commercial or civil buildings.

BACKGROUND ART

The background art comprises conduits having square or rectangular sections having flanges to their ends and having standard lengths. Normally, these flanged elements have length of 1.5 meter and, for realizing air conduit having a greater length, several elements connected each other through the flanges are required.

These elements of the conduit having rectangular section comprise flanges at their opposite ends. The maximum length of these element is imposed by the width of the metal sheets used for manufacturing these elements, which normally have width not exceeding 1.5 meter.

Notoriously these flanged elements of the conduit having rectangular section have the inconvenience of not guarantying a sufficient airtight. In these flanges and in particular in the angles of these flanges several air leakages occur. Further air leakages occur along the longitudinal seams. Using these types of elements is not possible to realize conduits having high tight standards if gaskets or insulating materials are not used. A conduit made of such rectangular elements and specific gaskets can satisfy at most the requirements of the rule EN13779—class A.

Consequently, the already known solution does not allow to guarantee high standard in term of tight and to create elements having length greater than 1.5 meters.

In the state of the art, seamed-locked spiral conduits having circular section are also known.

The lock seam conduits have a very good airtight and can be of any size.

An example of seamed-lock spiral conduit and the relative forming machine are illustrated in the U.S. Pat. No. 2,862,469. In this document is disclosed a solution wherein a forming machine pushes a metal strip by means of two motorized rollers against a spiral guide, which permits to the strip to wound itself following the guide shape. Opposite profiles of the metal helically wound strip are then seamed each other by means of a seaming device.

Further lock seam spiral conduits are known in the state of the art, but they are all with circular section. The main inconvenient of this type of conduit is the shape of the section. The circle has an area which is less than about 20% with respect to the square which circumscribes it. A conduit having circular section permits a volumetric flow rate minor than a conduit having equal height and square section. Furthermore, the most aimed section for conduits is the rectangular one, because it permits to have a minor height caliper for a given area. A rectangular section of the spiral conduit allows to use the conduit also in rooms having low heights, for example it can be installed between the false ceiling and the ceiling in the civilians' home. Actually, in the state of the art, a method or a system for realizing a spiral lock seam conduit having rectangular or square section.

To overcome this problem is known to seam lock spiral conduits having circular section and subsequently to deform them through specific machines. The circular conduits are pulled from opposite sides until the section of the conduit looks like an oval, so with two straight sides and two curved sides.

This type of lock seamed ovoid spiral conduit is very complex and expensive to be realized, because two processes are required: forming and deforming. An example of a deforming machine for this scope is provided by the U.S. Pat. No. 4,803,881. Finally it's known, from document U.S. Pat. No. 2,440,792, an apparatus for forming conduits having substantially rectangular section from a metal strip having scarce bandwidth. The apparatus of this document uses a structural wire seamed together with the metal strip to reduce the stresses in the seamed profiles. With conduits having a polygonal section and sides with different lengths, and a strict strip, said apparatus generates too fragile conduits and consequently conduits that are not employable for venting air.

SUMMARY

Said drawbacks of the state of the art are now solved by an apparatus for forming in continuous a spiral seamed conduit from a metallic strip. Said forming apparatus comprises a feeding plane for said metallic strip, a forming head rotating about a forming axis tilted by a forming angle with respect to a direction orthogonal to a feeding direction of the metallic strip, a lock-seaming device configured to lock in continuous two portions of said metallic strip along opposite profiles for forming said spiral seamed conduit. Said forming head being adapted to drive in rotation said metallic strip for defining a spiral conduit. Said forming head being provided with one or more forming elements arranged and configured so to define a substantially polygonal shape for the section of said spiral conduit during the drag in rotation of said metallic strip. Said lock-seaming device being moveable, thus configured to move, along a seaming direction so to lock said two portions on a side of said conduit.

Said substantially polygonal section being substantially rectangular or square.

sSaid apparatus allows to realize continuously spiral lock seam conduit having polygonal section, in particular square or rectangular. Terms "continuously" or "in continuous" indicate the capability of the apparatus of realizing conduits having polygonal sections without further deforming activities and of any desirable length.

Said forming axis is orthogonal to the feeding direction of the metal strip and parallel to the feeding plane of the apparatus.

The lock-seaming device is movable between a first and second position and said forming head is configured to roto-translate when said lock-seaming device is positioned in said first position or in said second position, to avoid deformations or breaks in the strip material.

Said forming head and said lock-seaming device can move with respect to the feeding plane when a side of the conduit is placed on the feeding plane. This movement allows to short the length of the feeding plane because the head moves on the feeding plane at each rotation.

The forming elements can be one or more. In particular, the forming elements are four extendable arms connected to a base of said forming head lying on axes parallel to the forming axis and arranged so to engage said strip simultaneously or in group of three.

Alternatively, the forming element can be one and in particular a disc having a thickness equal or higher than the bandwidth of the metallic strip and having a shape substantially polygonal, preferably substantially rectangular or square. Said disc being adapted to form, by means of its shape, the polygonal section of said spiral conduit during the rotation of the forming head.

In both versions, the forming elements allow to bend the strip for forming the spiral conduit efficiently.

Said forming head is movable according to a first vertical direction to maintain the distance between one of the forming elements and the feeding plane constant during the rotation of the forming head. Said head is also movable according to a second direction parallel to the feeding direction of the strip, to compensate the movement in the opposite direction of the forming head during the forming process. Said head is also movable along said forming axis according to a direction to compensate eventual misalignments of the lock-seaming device with respect to the strip to be seamed. Said movements of the forming head allow to avoid deformations or breaks in the strip material.

Said forming angle can vary during the rotation of the forming head if the sides of said substantially polygonal shape have different lengths, for example if the section is rectangular. This variation of the forming angle allows to adjust the overlapping of the opposite profiles and to avoid a seaming not correctly performed.

Said lock-seaming device can engage in continuous two portions of the same strip and comprises a first lower clinching roller cooperating with a second upper clinching roller or with said disc to bend edges of opposite profiles of the strip on each other. The seaming so realized allows to guarantee a great airtight of the conduit when air under pressure transits into the conduit.

Said apparatus can also comprise a spool-stand containing the metallic strip arranged upstream the forming apparatus for facilitating the manufacturing of conduits having extended lengths and in any case having lengths above 1.5 meters.

Said apparatus can also comprise a device arranged downstream the forming apparatus for cutting the spiral lock seam conduit at any desirable length.

A further scope of the present invention is that of providing a process for forming in continuous a spiral conduit having a substantially polygonal section. The process comprises the following steps: feeding a rotary forming head with a metallic strip according to a feeding direction; driving in rotation said metallic strip rotating said forming head; spirally bending said metallic strip by means of said forming head during the rotation of the head itself, being the rotational axis of the forming head tilted by a forming angle with respect to a direction orthogonal to the feeding direction of the metallic strip; locking in continuous by seaming two portions of the strip along opposite profiles along a seaming direction; wherein said forming head is provided with one or more forming elements adapted to define a substantially polygonal shape for the section of said spiral conduit during the dragging in rotation of said metallic strip. Said process allows to realize in continuous spiral lock seam conduits having polygonal cross-section, in particular square and rectangular, having variable length and in any case longer than those actually available in the market.

Said process can comprise the step of adjusting the overlapping of said portions of the strip along opposite longitudinal profiles, moving the forming head according to one or more of the following axes: an axis parallel to the seaming direction, a vertical axis, a rotational axis of the forming head. Said shifting movements of the forming head allow to avoid deformations or breaks of the strip material.

Finally a further scope of the present invention is represented by a spiral conduit having a substantially polygonal section, preferably rectangular or square, comprising a metallic strip seamed along opposite profiles. A conduit so conceived can be realized by means of the apparatus and/or the process according to previous two scopes or by means of different means/methods, and allows to optimize the size of the conduit for a given volumetric flow rate, with respect to the existing solutions.

These and other advantages will be better understood thanks to the following description of different embodiments of said invention given as non-limitative examples thereof, making reference to the annexed drawings.

DRAWINGS DESCRIPTION

In the drawings:

FIG. 9 shows an axonometric schematic view of the forming head and of the lock-seaming device of said first embodiment;

FIG. 10 shows schematically a lateral view of the forming head and of the lock-seaming device of FIG. 9;

DETAILED DESCRIPTION

The following description of one or more embodiments of the invention is referred to the annexed drawings. The same reference numbers indicate equal or similar parts. The object of the protection is defined by the annexed claims.

Technical details, structures or characteristics of the solutions here-below described can be combined each other in any suitable way.

Figure 1:
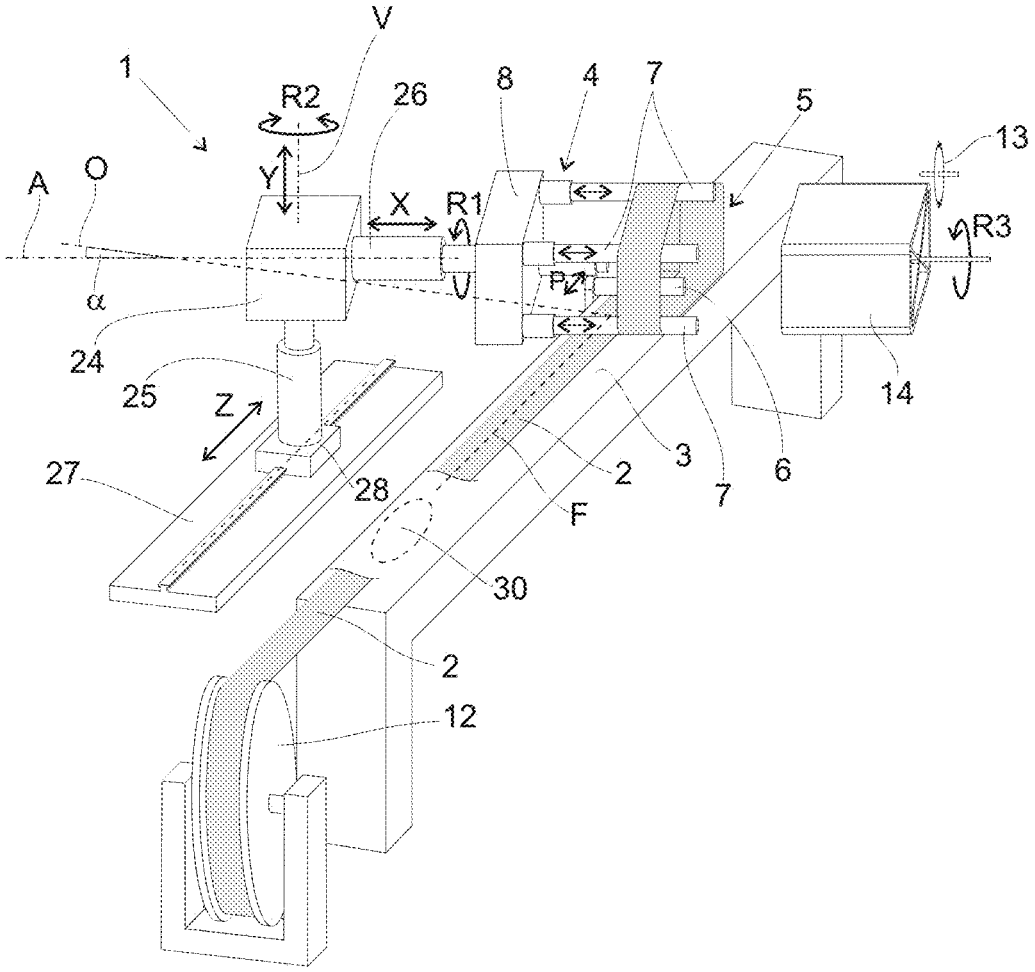
FIG. 1 shows a schematic axonometric view of an apparatus of the present invention according to a first embodiment.

With reference to FIG. 1 is described the forming apparatus 1 which in continuous realizes a lock seamed spiral conduit 5 from a metallic strip 2 according to a first embodiment. A metallic strip 2 is feed on a plane 3 according to a feeding direction F. The direction F is substantially parallel to the longitudinal development of the plane 3. Said metallic strip 2 is initially connected to the forming head 4 to start the driving of the strip 2 itself. Said forming head 4 comprises a base 8 from which at least three, preferably four, forming elements 7 cantilever extend. Said connection of the strip 2 with the forming head 4 can be made through the insertion of an end of the strip 2 into a channel (not shown) arranged in one of the forming elements 7. Alternatively, said strip 2 can be partially wounded about a forming element 7. Eventual alternative systems of anchoring of the metal strip 2 to the forming head can be conceived, provided that they allow to drag the strip 2 along the feeding direction F when the head 4 starts its rotation according to the rotational direction R1.

Figure 4:
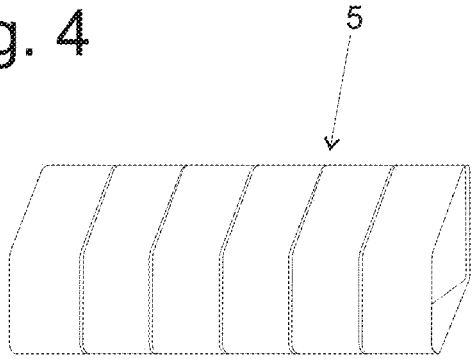
FIG. 4 shows a spiral lock seam conduit having rectangular cross-section.

The forming head 4 is configured to rotate with a rotation R1 about a forming axis A which is inclined with respect to the orthogonal direction O to the forming direction F. The forming head 4 is movable according to five axes as explained in details in further detail below. The rotational direction R1 of the forming head 4 is so to pull the metallic strip 2 on the plane 3. The forming head 4 is shown in FIG. 1 with four forming elements 7 arranged so to realize a conduit 5 having a cross-section substantially square, as illustrated in FIG. 4. With the same number of forming elements 7, but arranged differently on the base 8, is possible to realize a section substantially rectangular.

Further sections of the conduit 5 can be obtained positioning the forming element 7 differently and according to different geometries. Also the number of forming elements 7 can vary. For example, with six forming elements arranged at the same distance from the forming axis A and arranged each 60°, a substantially hexagonal spiral conduit is obtainable.

The term "substantially square" refers to a square shape not having sharped angles. Similarly, the term "substantially rectangular" means a rectangular shape not having sharped angles. Referring to FIG. 3, the smoothing radius of angles of the square, rectangular or any polygonal shape is function of the diameter D of the portion of the forming element 7 engaging the strip 2.

The forming elements 7 can be cylindrical to facilitate the bending of the strip 2 and to avoid breaks in the strip material.

The forming elements 7 can even have a substantially square shape for obtaining conduits 5 with sharped angles.

The drawings, as well as the description, refer to an apparatus adapted to manufacture a conduit having substantially square or rectangular shape. The teaching can be easily adapted by the skilled man in the art to any other polygonal shape.

The forming elements 7 are connected to the base 8 and can slide with respect to it, as shown in FIG. 1, or can be configured to elongate or shorten the distance between their cantilevered ends and the base 8. In the latter case, the forming elements 7 can be extendable arms which can be extended through hydraulic or pneumatic systems. As shown in FIG. 9, the extendable arms 29 allow to move the forming elements 7 between an extended configuration 18' and a retracted configuration 18". In the extended configuration 18' the forming elements 7 engage the metallic strip 2, while in the retracted configuration 18" the forming element 7 does not engage the metallic strip 2.

Rotating the head 4 according to R1, the strip 2 is attracted toward the head 4 itself. Rotating the head 4, the strip 2 comes into contact with the forming elements 7 of the head 4. The strip 2, lying on the forming elements 7, is able to adhere to part of the external surface of the forming element 7 thanks to the strain generated by the pull of the rotating head 4. Depending on how the forming elements 7 are arranged on the base 8, the wounded strip 2 assumes the shape imposed by forming elements 7 by bending.

Being the material of the strip 2 such that it deforms plastically, the shape imposed by the head 4 is not reversible. The strip 2 needs to be sufficiently ductile to be bent by the forming head 4.

The spool-stand 12 supporting the strip 2, can be configured to resist to the dragging of strip 2 exerted by the head 4 so to facilitate the forming of the strip 2 on the forming elements 7. When the forming head 4 bends the strip 2, the plane 3 works as opposite contact.

The forming head 4 is movable according to five axes, but the distance of at least one of forming elements 7 from the plane 3 is constant over time. As FIG. 8 shows, at least a forming element 7 is always at a constant distance from the plane 3. Rotating the head 4, the element or the elements 7 are sequentially in this condition. The constant distance allows to the strip 2 to be always vertically constrained to the plane 3 and to the forming element 7, which is at a constant distance from the plane 3. This distance can be slightly higher than the metal strip 2 thickness. The thickness of the strip 2 is a function of the area of the conduit cross-section 5.

The forming head 4 rotates about a forming axis A which is inclined with respect to the direction O orthogonal to the feeding direction F by an angle $\alpha$ which is a function of the width of the strip 2 and of the shape and dimension of the conduit section.

Figure 3A:
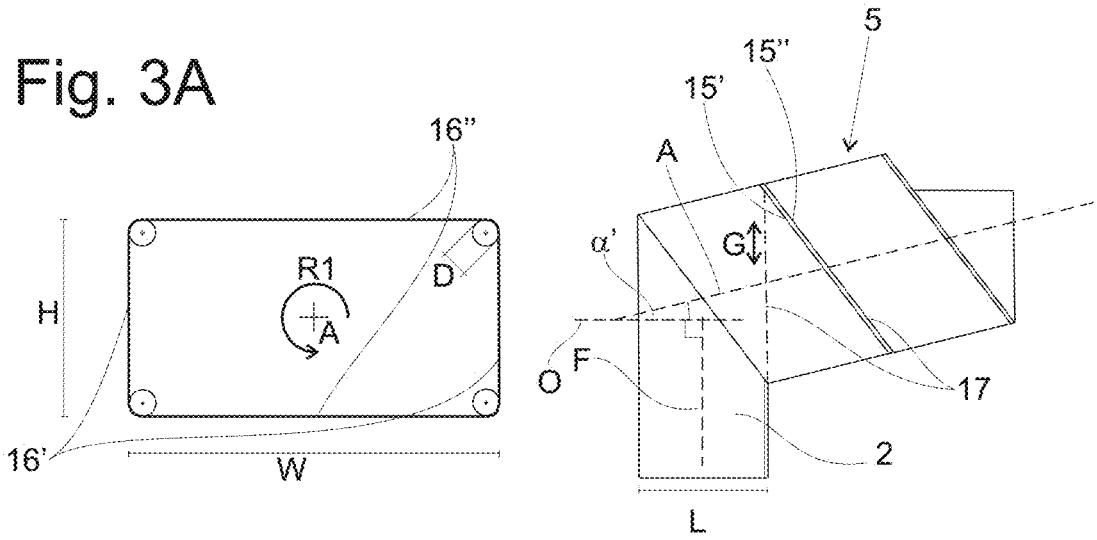
FIGS. 3A and 3B show schematically subsequent phases of the forming process of a spiral lock seam conduit having rectangular section viewed frontally and from above.
Figure 3B:
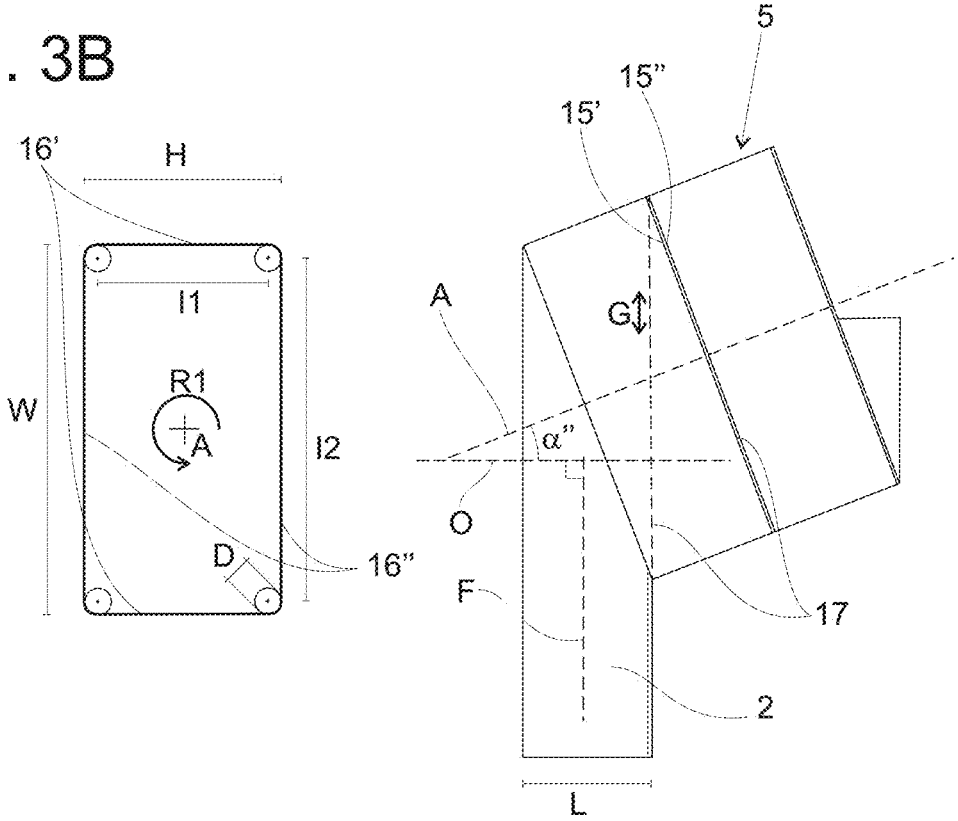

As shown in FIGS. 3A and 3B, when the apparatus 1 seams the short side of a conduit 5 having rectangular section, the angle $\alpha'$ is sharper, while when the same apparatus 1 seams the long side of the rectangle, the angle $\alpha''$ is larger than the angle $\alpha'$. The angle $\alpha$ is thus function of the length of the side to seam.

Figure 5A:
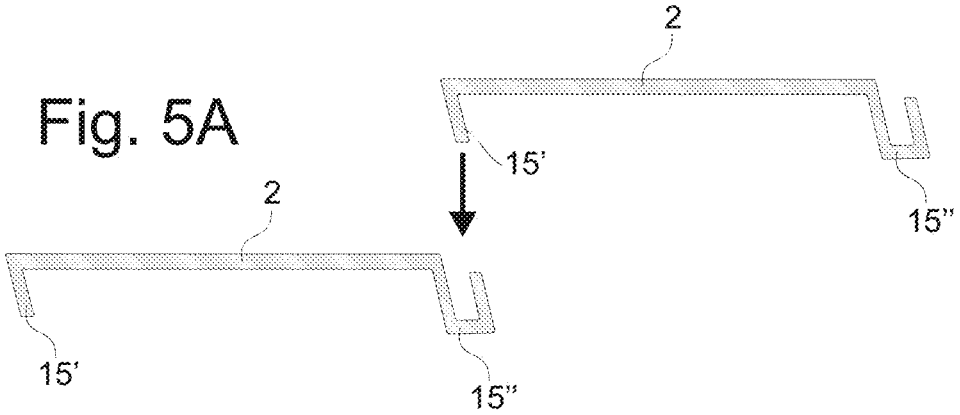
FIGS. 5A, 5B and 5C show in a simplified manner subsequent phases of the seaming process of the metal strip in a cross-sectional view.
Figure 5B:
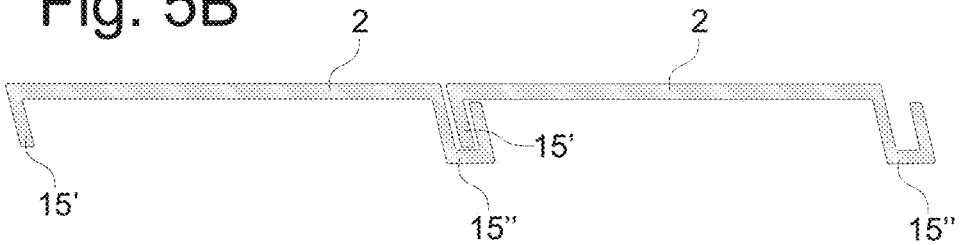

The apparatus 1 is configured to spirally wound the strip 2 so that opposite profiles of the strip 2 overlap. The angle $\alpha$ is so that an overlapping of the opposite profiles occurs. Said opposite profiles 15', 15" are complementary as shown in FIG. 5. The sections of the opposite profiles 15', 15" have complementary shapes to permit the joining of two portions of the strip 2 (FIG. 5B) and the subsequent seaming, when the profiles 15', 15" are punched one on the other as shown in FIG. 5C.

The forming head 4 spirally wounds the strip 2 and the tilting angle $\alpha$ of forming axis A is selected to permit the insertion of a first profile 15' of the strip 2 in a second profile 15" of the strip 2. Complementary shapes different from that of FIG. 5 can be selected between those available to the skilled man in the art.

The apparatus 1 can also comprise a device for edging the strip 2 (shown schematically with sign 30 in FIG. 1) arranged upstream the forming head 4. Said edging device comprises a series of rollers configured to shape by bending in continuous a metal planar strip. Said edging device can comprise a plurality of shaping rollers arranged so that the planar strip is bent to form two opposite profiles having complementary shapes like that of FIG. 5. The strip enters planar in the edging device and exits with a profile shaped so to realize the seaming. For this scope edging machines suitable for strip available on the market can be used.

Figure 5C:
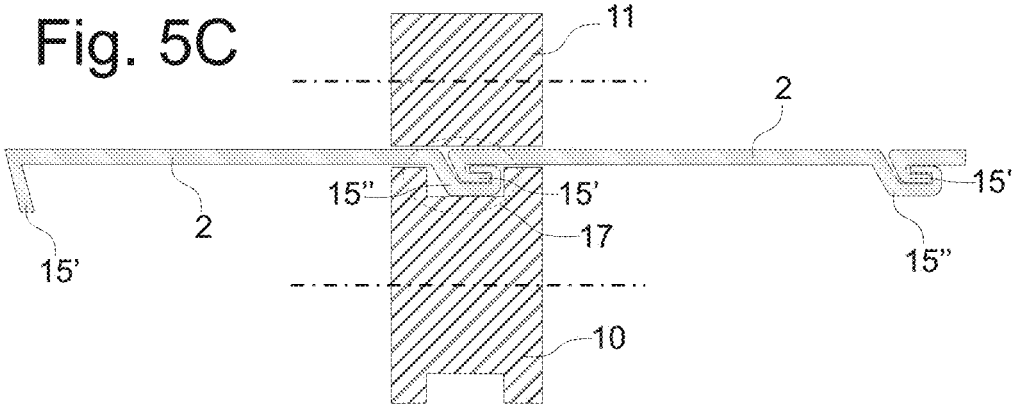

In FIG. 5C are shown other two elements of the apparatus 1, thus the lower clinching roller 10 and the upper clinching roller 11 of the lock-seaming device 6. These rollers 10, 11 are shaped so to press the profiles 15', 15" one on the other when they roll on the strip 2. Pressing the profiles 15', 15" the hook profile 15" is bent, forcing the profile 15' to bend over the profile 15" so to join them. In particular, the lower clinching roller 10 has a cross-section shaped like a "H", while the upper clinching roller 11 has a shape substantially cylindrical. The two rollers 10, 11 are arranged at a respective distance equal or slightly higher than the strip thickness.

In this way, the seaming 17 is realized between opposite profiles 15', 15" and the airtight of the conduit 5 along the seaming 17 is extremely good so that the conduit satisfies the standards of class B of the EN 13779 rule, without any gasket in the joining between subsequent conduits 5. Adding gaskets in the joining area between two subsequent conduits 5, the airtight can satisfy the standard of class C of the EN 13779. In the case of a single piece of conduit 5, the airtight results can be even higher, so to satisfy the class D standards of this rule.

The seaming 17 so realized is optimal to reduce the flowing resistance of the fluid in the conduit 5, because the seamed profiles protrude externally to the conduit. The portions of strip 2 seamed are aligned on the inner side as shown in FIG. 5C. Said seaming 17 is visible also in FIGS. 2 and 3.

Figure 2:
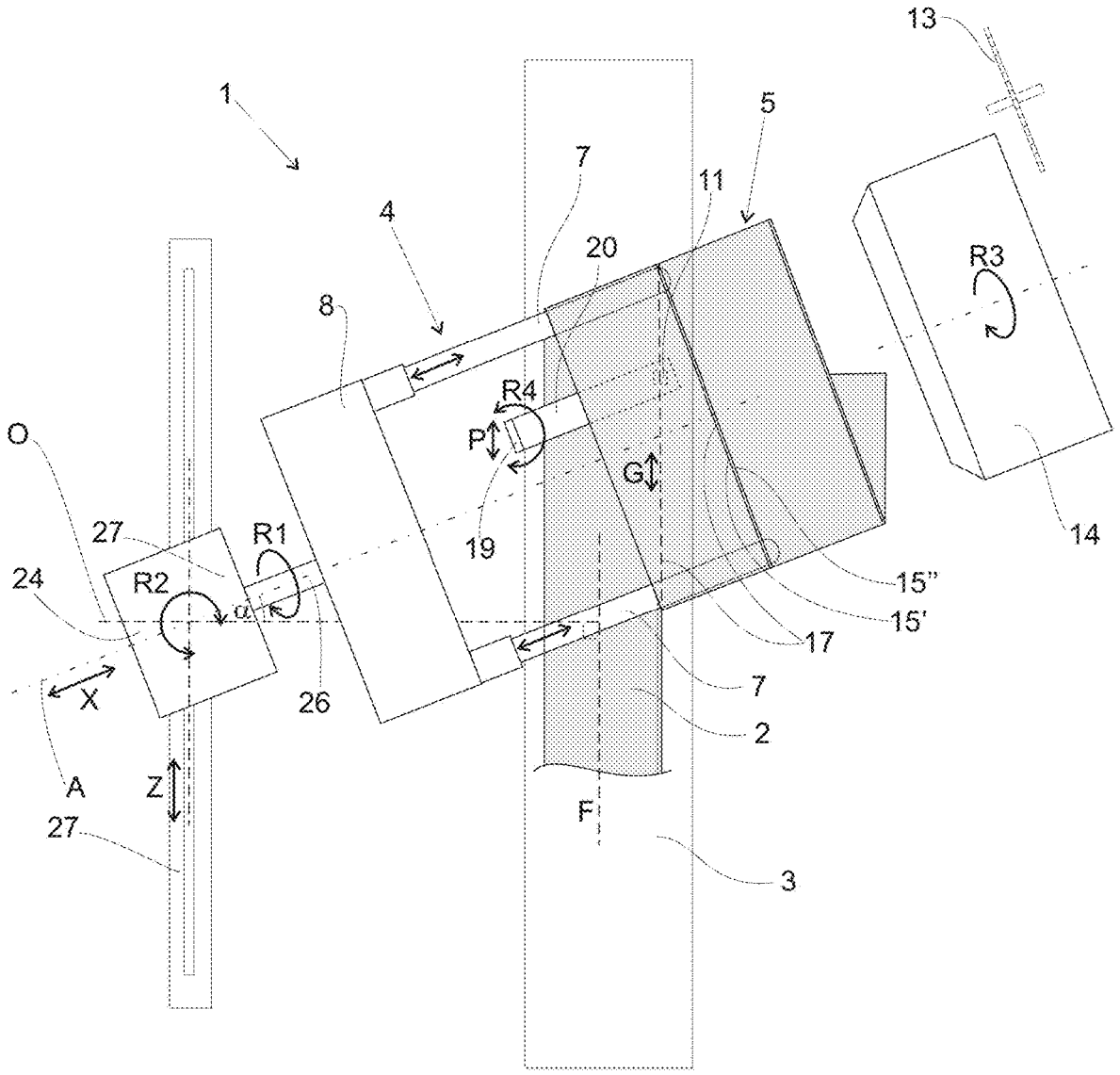
FIG. 2 shows an upper schematic view of an apparatus of the present invention according to a first embodiment.

With particular reference to FIGS. 2 and 9, the lock-seaming device 6 comprises a seaming support 19 moveable according to a direction P along the plane 3 and a seaming profile 20 having shape similar to that of forming elements 7 and same diameter D. Internally to the seaming profile 20 is housed and turnably connected the upper clinching roller 11. The lower clinching roller 10 is connected to the seaming support 19. Said upper and lower rollers 10, 11 are arranged each other so that their rotary axes are perpendicular to the seaming direction G and can be not coincident with the axis of the seaming profile 20. The lock-seaming device 6 so conceived can roll on opposite profiles of the strip 2 to join them by seaming along the seaming direction G.

The lock-seaming device 6 moves, for each side of the polygonal conduit 5, between a first position and a second position, going through the whole overlapping zone of the overlapped profiles and realizing the seaming 17. Said device 6 moves substantially between opposite corners of the same conduit 5. The seaming direction G is preferably parallel to the feeding direction F. Also the moving direction P of the seaming support 19 is preferably parallel to the seaming direction G.

The above description will be more clear looking at FIG. 8 where the steps of the dragging, forming and seaming the strip 2 are shown.

The arrows indicate the sequence of movements performed by the seaming head 4, by the forming elements 7 and by the lock-seaming device 6 with respect to the plane 3.

With signs I and II are indicated the two position of start and end of stroke of the lock-seaming device 6 and in particular of its rollers 10, 11, which move between these two positions along the seaming direction G. The lock-seaming device 6 comprises the seaming profile 10 which supports the upper clinching roller 11.

Figures 8A, 8B, 8C, 8D, 8E, 8F, 8G, 8H, 8I, 8L:
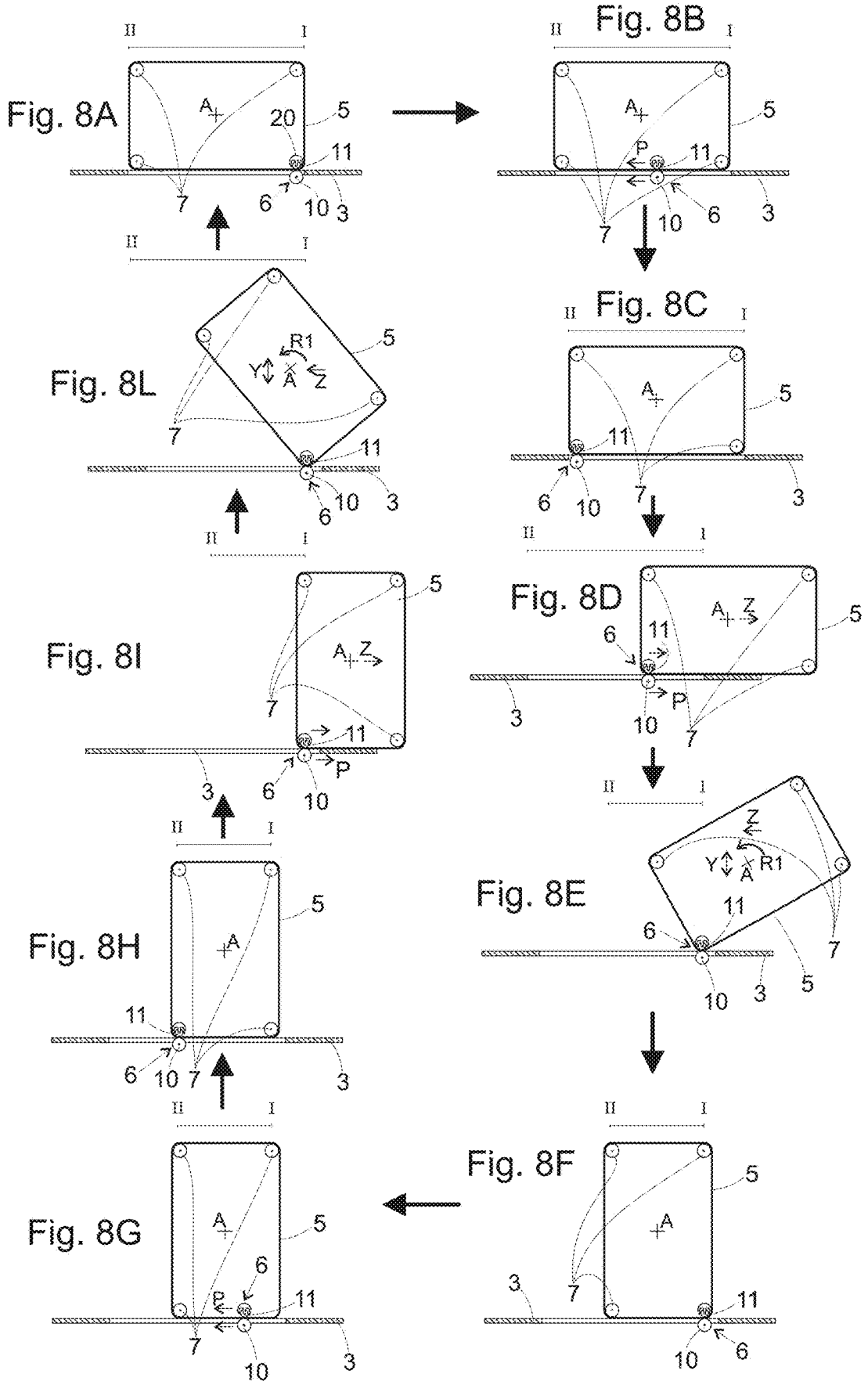
FIG. 8 shows the sequence of movements of the forming apparatus to seam consecutive sides of the spiral conduit having rectangular section.

In FIG. 8A the conduit lies on the plane 3 on its long side and the lock-seaming device 6 is positioned in correspondence of a corner of the conduit 5, thus in the start position I. From the corner, the device 6 starts its movement along the seaming direction G (FIG. 8B) until it reaches the opposite corner (FIG. 8C) and by these movements the upper and lower rollers 10, 11 punch the opposite profiles of the strip 2 realizing said seaming 17 of this side of the conduit 5.

The term corner means the corner of the polygonal conduit 5, even if this corner is not sharped.

When the lock-seaming device 6 is in the end stroke position II, the forming head 4 moves according to the second direction Z together with the lock-seaming device 6, which moves according to the direction P, to bring the lock-seaming device 6 in the start stroke position I (FIG. 8D). With this movement also the strip 2 is dragged. The dragged portion of the strip 2 will be formed and seamed in the next step.

Once the lock-seaming device 6 reaches the start stroke position I, the forming head 4 rotates according to a rotary direction R1 and translates according to first direction Y and second direction Z, maintaining the contact of the strip 2 with the plane 3 and with the lock-seaming device 6 (FIG. 8E). Substantially, a rotation of the forming head 4 and of the formed strip 2 about the contact line of the seaming profile 20 with the strip 2 occurs.

Once the roto-translation of the forming head 4 is finished, the conduit 5 lies on the plane 3 with its short side and the lock-seaming device 6 is still in the start stroke position I (FIG. 8F).

At this point the lock-seaming device 6 can move from the start stroke position I toward the end stroke position 11 along the seaming direction G (FIG. 8G).

Once the lock-seaming device 6 reaches the end stroke position 11 (FIG. 8H), also this side of the conduit 5 is seamed, because the upper and lower rollers 10, 11, moving on the short side, have punched the opposite profiles of the strip 2 realizing said seaming 17 of the short side of the conduit 5.

At this point, the lock-seaming device 6 is in the end stroke position II and the forming head 4 moves according to the second direction Z together with the lock-seaming device 6, which moves according to the direction P, to bring back the lock-seaming device 6 in the start stroke position I (FIG. 8I). With this movement the strip 2 is dragged according to the feeding direction F for being, in the next steps, bended and seamed.

Once the lock-seaming device 6 reaches the start stroke position I, the forming head 4 rotates according to a rotary direction R1 and moves according to a first vertical direction Y and a second direction Z, maintaining the contact between the strip 2 and the plane 3 and the lock-seaming device 6 (FIG. 8L). Substantially, a rotation of the forming head 4 together with the formed conduit 5 is realized about the contact line of the seaming profile 20 with the strip 2.

Once the roto-translation of the forming head 4 is performed, the conduit 5 lies on the plane 3 with its long side, opposite to the long side already seamed, and the lock-seaming device 6 is in the position of start stroke I.

The forming head 4, the forming element 7, the lock-seaming device 6 and the conduit 5 are in a configuration equivalent to that shown in FIG. 8A and the dragging (or driving), forming and seaming processes of the strip 2 can start again according to the sequence already described, until a desired length of the conduit 5 is reached.

The order of the sequence described above can be varied without overcoming the scope of the present invention. For example, when the lock-seaming device 6 is in the end stroke position II, the forming head 4 can rotate according to a rotary direction R1 and moves according to the first vertical direction Y and to the second direction Z to overturn the conduit 5 on the short side; once the conduit 5 is overturned, the forming head 4 can move according to the second direction Z together with the lock-seaming device 6 to bring back the lock-seaming device 6 in the start stroke position I.

The apparatus 1 also comprises means configured to move the forming head 4 according to a plurality of axes. In particular, said means are configured to move vertically the head 4, according to a vertical direction Y. Said means are also configured to move it along a direction Z parallel to the longitudinal extension of the plane 3 and preferably parallel to the feeding direction F. Said means are also configured to move said head 4 along the forming axis A according to a direction X. In this manner the head is adapted to move in the three dimensions of the space.

Said means are also configured to move the head 4 according to other two axes. Said means are configured to rotate the head 4 about a vertical axis V according to rotary direction R2. Furthermore said means are configured to rotate the head 4 about the forming axis A according to a rotary direction R1.

Overall, said means are configured to move the forming head 4 according to five axes.

Said means can be a control numeric machine comprising:

motors adapted to act the movements of said axes;

a plurality of encoders, to inform an onboard computer on the movements and on the position of said axes;

a power supply unit adapted to control said motors;

a control computer configured to acquire and elaborate said data of the encoders, the instructions inputted by an operator and the instructions provided by a program which calculates the position of the forming head 4 governing the movements during the execution of the work activity.

Said control numeric machine can comprise a board 28 movable by a first motor (not shown) according to the direction Z along a platform 27 provided with a rail, a first motorized arm 25 installed in said board 28 and configured to move the counterhead 24 according to the vertical direction Y, a second motorized arm 26 installed on the counterhead 24 and configured to move said forming head 4 according to the direction X. Said counterhead 24 can comprise a first motor (not shown) to rotate according to the direction R2 the counterhead 24 with respect to the platform 27, thus about the vertical direction V, and a second motor (not shown) to rotate according to the direction R1 said forming head 4 about the forming axis A.

Alternatively to said control numeric machine described above, any machine or robotic arm having five degrees of freedom can be easily employed and adapted to this scope by the skilled man in art using the common general knowledge. Alternative systems for moving the forming head 4 according to five axes are possible and technically equivalents to the described solution.

Said movements along the three directions X, Y, Z, allow to the forming head 4 to maintain at least a forming element 4 to a constant distance from the plane 3 according to the vertical direction and to rotate the forming head 4 by a forming angle α with respect to a predetermined point. Said predetermined point being the point in which the lock-seaming device 6 is in contact with the conduit 5.

When the apparatus 1 needs to seam a side of the conduit 5 having a length different from the side previously seamed, as shown in FIG. 3, the forming head 4 needs to modify the forming angle α, thus the inclination of the head 4 with respect to the orthogonal direction O. To minimize the stresses and the forces in the material of the conduit 5, the head 4 rotates about a point wherein the conduit 5 is anchored to the plane 3, thus the point in which the rollers 10, 11 come into contact with the opposite profiles of the conduit 2. This point represents an ideal fulcrum for the forming head 4, which needs to move contemporary in the directions X and Z and to rotate according to the direction R2, to vary the angle α.

This movement of the forming head 4 occurs maintaining the distance between the conduit 5 and the plane 3 constant, because of the opposite profiles of the strip 2 are vertically blocked by the rollers 10, 11. Beside varying its angle of incidence a with the plane 3, the forming head 4 needs also to rotate about the forming axis A to form the strip 2 and to overturn the conduit 5. For this reason a further movement of the head 4 occurs in contemporary or subsequently to the movements along X, Y and R2. The forming head 4 rotates about its axis A according to a rotary direction R1, but it needs to move also on the direction Z and on the vertical direction Y, in order to maintain the distance between the point of contact of the conduit 5 with the rollers 10, 11 and the plane 3 constant.

The forming head 4 moves contemporary along its five axes to modify the forming angle α and to overturn the conduit 5 with respect to the point of contact of the conduit 5 with the rollers 10, 11.

During this rotation and inclination of the head 4 is preferable that the lock-seaming device 6 is in correspondence of a corner of the conduit 5, preferably in the start stroke position I or in the end stroke position II. During the overturning of the conduit 5, said lock-seaming device 6 continues to seam in the zone of the conduit 5 corresponding to the corner.

When the length of the sides of the conduit 5 are not equal, for example in the case shown in FIGS. 3 and 9, wherein the conduit has a rectangular section, a rotation of the lock-seaming device 6 occurs in addition to the movement of the forming head 4. In particular, said seaming profile 20 rotates with respect to the seaming support 19, thanks to a moving device (not shown), according to a rotary direction R4, so that its axis is parallel to that of the forming element 7.

Since the lock-seaming device 6 contributes to form and bend the strip 2 when it is in the start stroke position I or in the end stroke position II, the seaming profile 20 has the same shape of the forming elements 7 for engaging the strip 2 and the same inclination a with respect to the plane 3.

When the inclination of the forming head 4 varies, also the inclination of the seaming profile 20 varies in the same way, so that said profile 20 and said forming elements 7 remain always parallel.

Said apparatus 1 can also comprise a cutting system 13 of the conduit 5. Said cutting system 13 can be a circular saw configured to cut the conduit 5 according to a plane orthogonal to the axis of the conduit 5 itself. This cutting system 13, schematically shown in FIGS. 1, 2 and 6, allows to cut the conduit 5 when it reaches a predetermined length, for example 1, 2 o 3 meters, in accordance with the standard lengths used in the market. Nevertheless, the present system allows to realize conduits having any length, according to the customer need or exigence.

Said apparatus 1 can also comprise a support 14 to hold up the formed conduit. Said support 14 is free to rotate about an axis coincident to the forming axis A according to a rotary direction R3. Said support 14 receives the portion of the conduit 5 already formed, supporting it and avoiding a bending of the which could cause the unseaming the seamed profiles.

Rotating the forming head 4, the conduit 5 rotates and together rotates also the support 14, being the conduit 5 lied on it. The support 14 can be neutral or motorized so to synchronize the movement with the head 4. The conduit 5 slides on the support 14 until a zone wherein the cutting system 13 is arranged to perform the cutting of the conduit 5.

Figure 11:
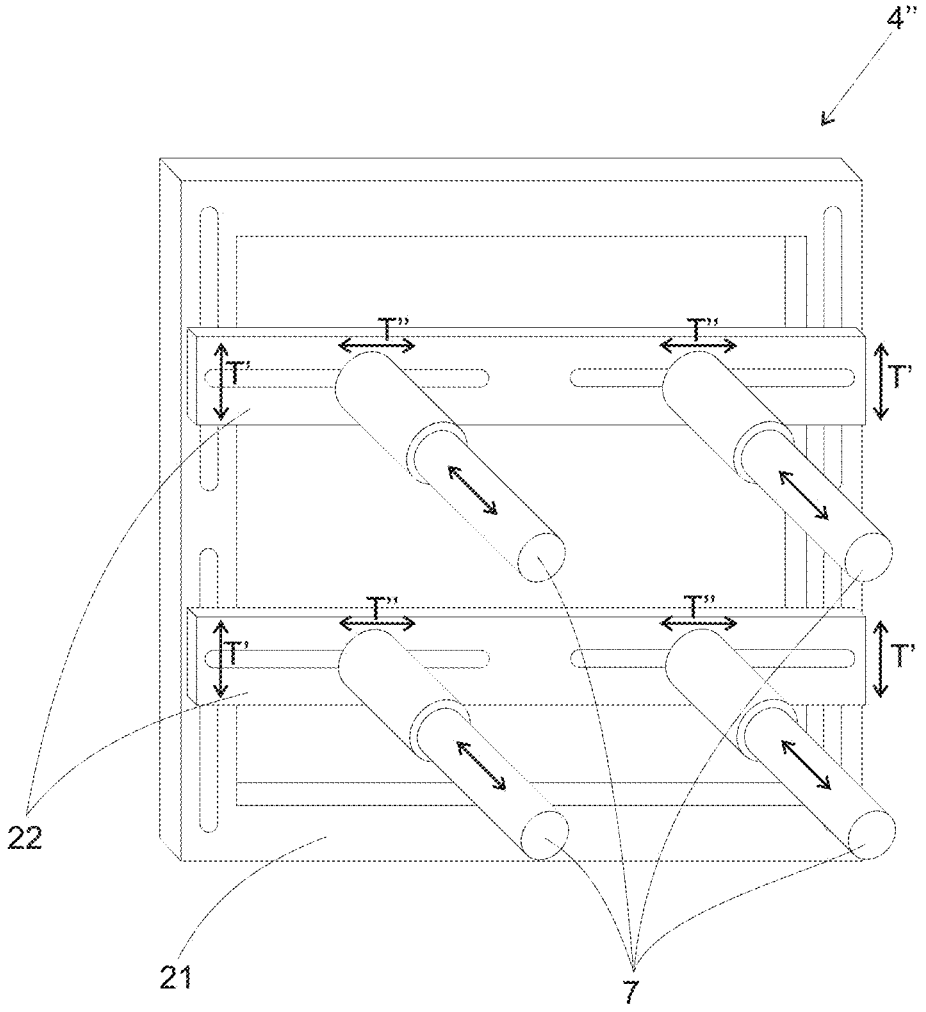
FIG. 11 shows schematically a particular version of the forming head having variable geometry.

In a particular version of said first embodiment of the forming apparatus 1, the forming head can have a variable geometry as shown in FIG. 11. In particular, said variable geometry forming head 4" comprises four forming elements 7' having variable length installed in twos on respective mobile supports 22. Said mobile supports 22 can move each other on a support structure 21 according to a direction T'.

Said forming elements 7' are in turn movable, with respect to the support structure 21, along said mobile supports 22 according to a direction T" orthogonal to the direction T' of movement of the mobile supports 22. Said support structure 21 is connected to said second motorized arm 26. Said mobile support 22 and said forming elements 7' are moved by respective drivers (not shown).

Figure 6:
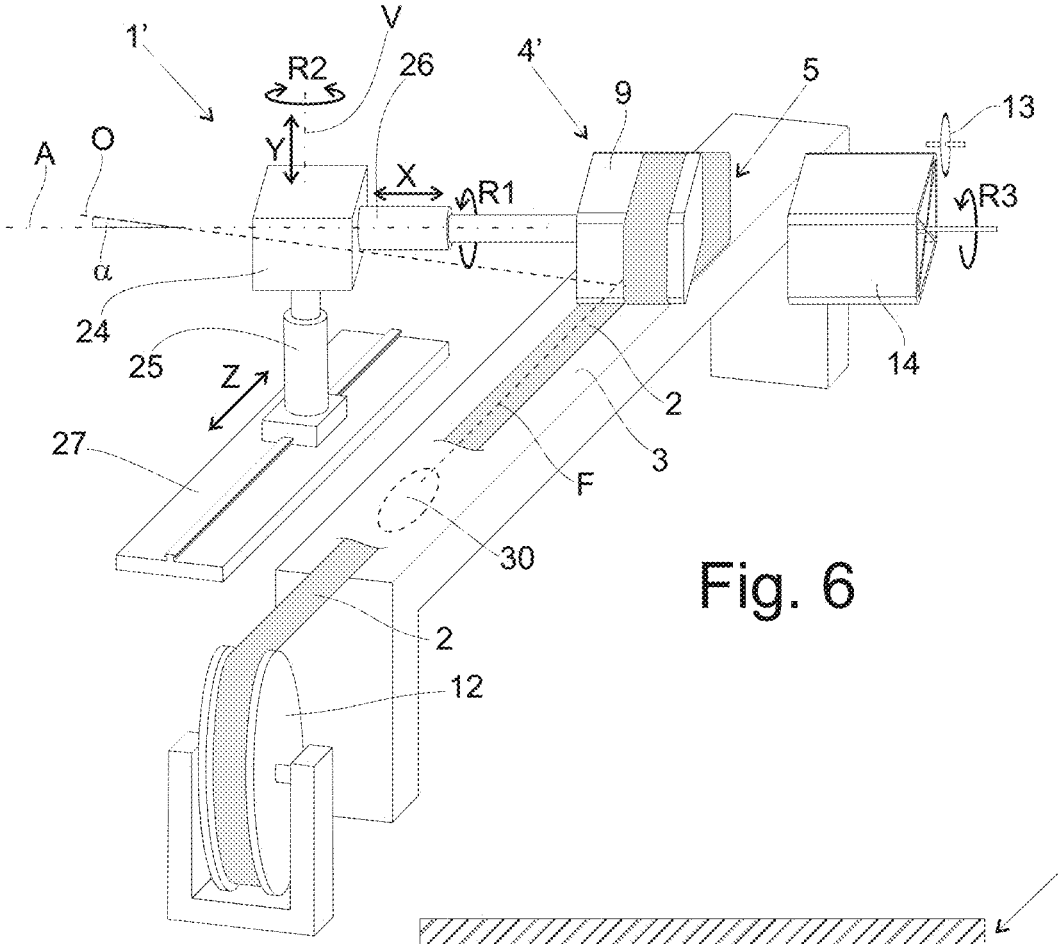
FIG. 6 shows a schematic axonometric view of the apparatus of the present invention according to a second embodiment.
Figure 7:
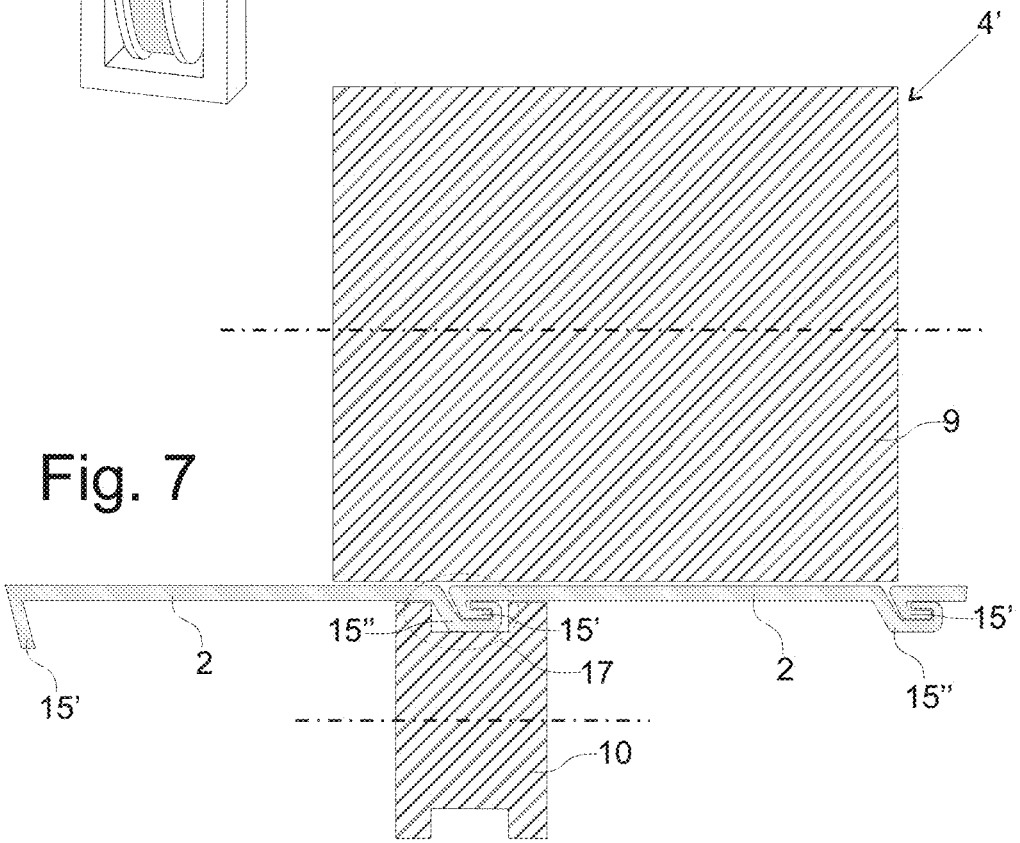
FIG. 7 shows in a simplified manner the seaming phase of the metal strip according to said second embodiment.

With reference to FIGS. 6 and 7, a second embodiment of the apparatus for forming in continuous a spiral seamed conduit from a metallic strip according to the present invention is shown. In particular, in FIG. 6 is shown a forming apparatus 1' which is substantially equal to that described so far, except for the forming head 4 and the lock-seaming device 6. In this second embodiment, the forming head 4' comprises a disc 9 having a predetermined shape.

Said disc 9 has a continuous lateral surface made of a rigid material. Said lateral surface has a width equal to the thickness of the strip 2, preferably equal to twice the strip thickness. For example in FIGS. 6 and 7, the disc 9 is shown as a solid having parallelepiped shape with a substantially square base. Alternatively, instead of a solid, the structure can have a continuous lateral surface and an internal skeleton partially empty.

Said disc 9 has a section corresponding to the desired shape of the conduit section.

For each type of conduit to be realized with the apparatus 1', the head 4' needs to be changed with that having the suitable shape for the conduit 5.

The lateral continuous surface of the disc 9 is rigid and configured so to work as dressing for the lower roller 10 during the seaming process.

During the seaming of a side of the conduit 5, the roller 10 rolls with respect to the disc 9. The disc 9 during the seaming lies with a side on the plane 3 through the strip 2.

As for the first embodiment, when the roller 10 rolls, the opposite and overlapped profiles of the strip 2 are hammered and seamed each other. The disc 9 during this phase works as dressing plate for the roller 10, being the strip 2 arranged between the disc 9 and the roller 10.

This particular version of the apparatus and of its forming head 4' having the disc 9, is technically simpler than that of the first embodiment, because the upper portion of the lock-seaming device is absent. Indeed, said lock-seaming device 6 comprises only the lower roller 10, which moves between the start stroke position I and the end stroke position II, along the seaming direction G.

All the elements and components of the apparatus 4 of the first embodiment are valid and compatible for the apparatus 4' of the second embodiment.

A further scope of the present invention is to provide a method for forming in continuous spiral conduits having a substantially polygonal section.

Said method or process comprises the step of feeding a rotary forming head 4 with a metallic strip 2 according to a feeding direction F. This strip 2 is dragged in rotation by the rotating forming head 4. Said strip 2 is spirally bent by the forming head 4 during its rotation, being the rotary axis of the forming head 4 tilted of a forming angle $\alpha$ with respect to the direction orthogonal O to the feeding direction F of the metallic strip 2. The bending of the strip 2 occurs because the forming head 4 forces the strip 2 to rotate, while another part of the strip lies on the feeding plane 3. This bending occurs wounding the strip onto the forming head 4 and following the shape of the head 4.

Once the strip 2 is bent, opposite profiles of the strip 2 are joined each other by seaming in a continuous manner.

Said substantially polygonal shape of the spiral conduit section is defined during the dragging in rotation of the metal strip 2 thanks to one or more forming elements 7 of the forming head 4. The overlapping of the opposite profiles of the strip 2 occurs adjusting the positioning of the profiles each other. To do that, the forming head 4 is moved according to one or more axes X, Y, Z.

Using an apparatus 1 according to the first embodiment, the forming elements 7 are a plurality, specifically as many as the sides of the polygonal shape of the conduit section 5. On the contrary, using an apparatus 1' according to the second embodiment, the forming element 4' is one and, specifically, is a disc 9 having a shape substantially equal to that of the conduit to be realized.

Represents a final scope of the present invention a conduit 5 having a substantially polygonal section and comprising a metallic strip 2 spirally wound and seamed along opposite profiles. In particular, a conduit 5 having square or rectangular section comprising a metal strip 2 said spiral conduit 5 has four flat sides spirally wound and seamed along opposite profiles of the strip 2. This conduit 5 is preferably realized by means of the apparatus and/or the process of the present invention. Said spirally seamed conduit 5 having four flat sides, joined by dull portions of the conduit, as shown in FIG. 4.

Thereby, it is clear that the invention so conceived can be susceptible of various modifications and variations, all covered by the scope of the invention; furthermore all the details are replaceable by technically equivalent elements. In practice, the materials used and the dimensions may be any according to the technical requirements.

The invention claimed is:

1. An apparatus for forming a continuous a spiral seamed conduit from a metallic strip comprising:

a feeding plane for said metallic strip;

a forming head configured to rotate about a forming axis substantially parallel to the feeding plane and tilted by a forming angle with respect to a direction orthogonal to a feeding direction of the metallic strip, wherein the forming head is adapted to drive in rotation said metallic strip for defining a spiral conduit;

a lock-seaming device configured to lock in continuous two portions of said metallic strip along opposite profiles for forming said spiral seamed conduit;

wherein said forming head is provided with one or more forming elements define a substantially polygonal shape for the section of said spiral conduit during the drive in rotation of said metallic strip;

wherein said lock-seaming device is configured to move along a seaming direction so to lock said two portions along a side of said conduit;

wherein said apparatus further comprises means configured to move the forming head according to a plurality of axes;

wherein said forming angle is configured vary during the rotation of the forming head if the sides of said substantially polygonal shape have different lengths.

2. The apparatus for forming a continuous spiral conduit according to claim 1, wherein said lock-seaming device is configured to move between a first position and a second position and said forming head roto-translates when said lock-seaming device is positioned in said first position or in said second position.

3. The apparatus for forming a continuous spiral conduit according to claim 1 wherein said forming head and said lock-seaming device is configured to move with respect to the feeding plane when a side of the conduit is placed on the feeding plane.

4. The apparatus for forming a continuous spiral conduit according to claim 1, wherein said substantially polygonal shape is substantially rectangular or square.

5. The apparatus for forming a continuous spiral conduit according to claim 1, wherein said forming elements are four extendable arms connected to a base of said forming head lying on axes parallel to the forming axis and arranged so to engage said strip simultaneous ly or in group of three.

6. The apparatus for forming a continuous spiral conduit according to claim 1, wherein said forming element is a disc having a thickness equal or larger than the width of the metallic strip and having a shape substantially polygonal, adapted to form the polygonal section of said spiral conduit during the rotation of the forming head.

7. The apparatus for forming a continuous spiral conduit according to claim 1, wherein the forming head is configured to move according to a first vertical direction to a second direction parallel to said feeding direction of the strip and along said forming axis according to a third direction.

8. The apparatus for forming a continuous spiral conduit according to claim 1, wherein said lock-seaming device is configured to engage in continuous two portions of the same strip and comprises a first lower clinching roller cooperating with a second upper clinching roller or with said disc to bend edges of opposite profiles of the strip on each other.

9. The apparatus for forming a continuous spiral conduit according to claim 1, further comprising a spool-stand of metallic strip arranged upstream the forming apparatus, a cutting device, or both, of the spiral seamed conduit arranged downstream the forming apparatus.

10. A method for forming a continuous spiral conduit having a substantially polygonal section, comprising the steps of:

feeding a rotary forming head with a metallic strip according to a feeding direction;

driving in rotation said metallic strip rotating said forming head spirally bending said metallic strip by means of said forming head during the rotation of the head itself, being the rotational axis of the forming head tilted by a forming angle with respect to a direction orthogonal to the feeding direction of the metallic strip moving a lock-seaming device along a seaming direction so to lock in continuous by seaming two opposite profiles of the strip to form said spiral seamed conduit moving the forming head according to a plurality of axes;

wherein said forming head comprises one or more forming elements that define a substantially polygonal shape for the section of said spiral conduit during the drive in rotation of said metallic strip;

wherein said forming angle is configured vary during the rotation of the forming head if the sides of said substantially polygonal shape have different lengths.

11. The method for forming a continuous spiral conduit according to claim 10, further comprising the steps of:

adjusting the overlapping of said portions of the strip along opposite longitudinal profiles;

moving the forming head according to one or more of an axis parallel to a seaming direction, a vertical axis, the rotational axis of the forming head.

* * * * *